United States Patent [19]

Herdzina, Jr.

[11] Patent Number: 4,936,729

[45] Date of Patent: Jun. 26, 1990

[54] PRESS WITH EXTERNAL TOOLING ARRANGEMENT

[75] Inventor: Frank J. Herdzina, Jr., Schaumburg, Ill.

[73] Assignee: Service Tool Die & Mfg. Company, Elk Grove Village, Ill.

[21] Appl. No.: 190,878

[22] Filed: May 6, 1988

[51] Int. Cl.[5] ..... B21D 43/12

[52] U.S. Cl. ..... 413/66; 413/62; 413/64; 413/12; 413/14; 72/346; 72/361

[58] Field of Search ..... 413/62, 64, 66, 12, 413/14; 72/346, 361

[56] References Cited

U.S. PATENT DOCUMENTS 3,196,817 7/1965 Fraze ..... 413/62
3,550,546 12/1970 Eickenhorst ..... 413/66
4,640,116 2/1987 Brown ..... 413/62
4,723,882 2/1988 Wissman et al. ..... 413/62

*Primary Examiner*—Frederick R. Schmidt
*Assistant Examiner*—Jack W. Lavinder
*Attorney, Agent, or Firm*—Kinzer,Plyer,Dorn, McEachran & Jambor

[57] ABSTRACT

A punch press has first and second sets of tooling mounted longitudinally of a press conveyor belt. The second set of tooling is located externally of the usual press columns. A second ram slidably mounted on the outside of the columns is driven by a connecting arm eccentrically mounted on a crankshaft extension. The second ram drives the upper tooling of the second tooling set in a reciprocating manner. The second ram can be operated out of phase with the main ram to reduce the total tonnage required of the press.

11 Claims, 2 Drawing Sheets

2
2
10
12
12
14
16
18
20
22
22
24
24
26
27
27
28
30
32
34
36
38
40
42
44
46
48
50
51
52
54
56
58
60
62
64
70
72
74
80
A

PRESS WITH EXTERNAL TOOLING ARRANGEMENT

BACKGROUND OF THE INVENTION

This invention relates to a conversion system or press. It is particularly adapted for conversion systems making easy-open can ends, although it will be understood that it could apply to presses manufacturing other types of parts.

Presses for converting ends for cans and the like are known. Presses of this general type are available from the Minster Machine Company of Minster, Ohio. U.S. Pat. No. 4,568,230 shows a general layout of a press for processing work pieces or shells into finished can ends with an opening tab attached thereto.

Presses used for the manufacture of easy-open can ends generally comprise a press bed mounted on legs which rest on the floor. Four columns or uprights or pillars are mounted on the press bed. The columns support a crown in which a main drive for the various press components is mounted. The columns also have slides or ways attached thereto for supporting a reciprocating main ram. The main ram carries the upper tooling of a main die set, which cooperates with lower tooling mounted on the bed. The main die set (which is also sometimes referred to as a lane die) defines a plurality of stations in which the shells are progressively converted into easy-open can ends. A conveyor carries the shells into and through the stations of the die set. The tabs are formed by tab tooling, which is supplied with strip stock by a stock feed mechanism. The tab tooling forms a tab and separates it from the strip stock for attachment to a can end.

The tab tooling has conventionally been mounted on the press bed laterally of the conveyor, and, for that matter, laterally of the lane die. The tab tooling may also be split so that it has die stations laterally placed on either side of the lane die. A bridge is required to transfer the tab stock strip across the lane die set. Such an arrangement is shown in U.S. Pat. No. 4,568,230. The upper tab tooling in this arrangement is mounted on the main ram on the press.

One of the deficiencies associated with this arrangement of the tooling is its difficult service access for maintenance of the tooling. Access to the lane die set is particularly difficult due to the presence of the tab tooling on one side of the main die and the tab tooling and tab stock feed mechanism on the other side. The lateral placement of the tab tooling also increases the depth of the press from front to back. This requires a larger bed which in turn increases the weight of the press and reduces its speed.

SUMMARY OF THE INVENTION

The present invention overcomes the disadvantages of laterally-placed, split tab tooling by locating the tab tooling longitudinally of the main die set. That is, instead of placing the tab tooling laterally of the conveyor's center line, it is placed longitudinally of the center line, either upstream or downstream of the main die set.

The present invention further provides a second ram for driving the second or tab tooling set. In a preferred embodiment, this ram is placed outside of the columns of the press. It is slidably mounted on the columns and is driven by a connecting arm eccentrically mounted on the main crankshaft.

Placing the tab or second die set longitudinally of the main die set allows full access to the main die, from either the front or back of the press. Neither the tab tooling nor its stock feed mechanism obstruct access to the main die set. This placement of the tab tooling also permits a reduction in the left to right width of the press between the columns. There is a corresponding reduction in weight, allowing the press to run at higher speeds. Another benefit of the tab tooling placement of the present invention is that it allows servicing the tab die within the press. It also makes possible the use of a drop-away/quick-lift bolster to assist in servicing the tooling.

The use of a second ram allows the tabs to be formed out of phase from the main ram, thereby reducing the total tonnage required of the press to convert products. The overall result of the construction of the press of the present invention is increased productivity through higher operating speed and reduced down time for maintenance.

DETAILED DESCRIPTION OF THE INVENTION

Figure 1:
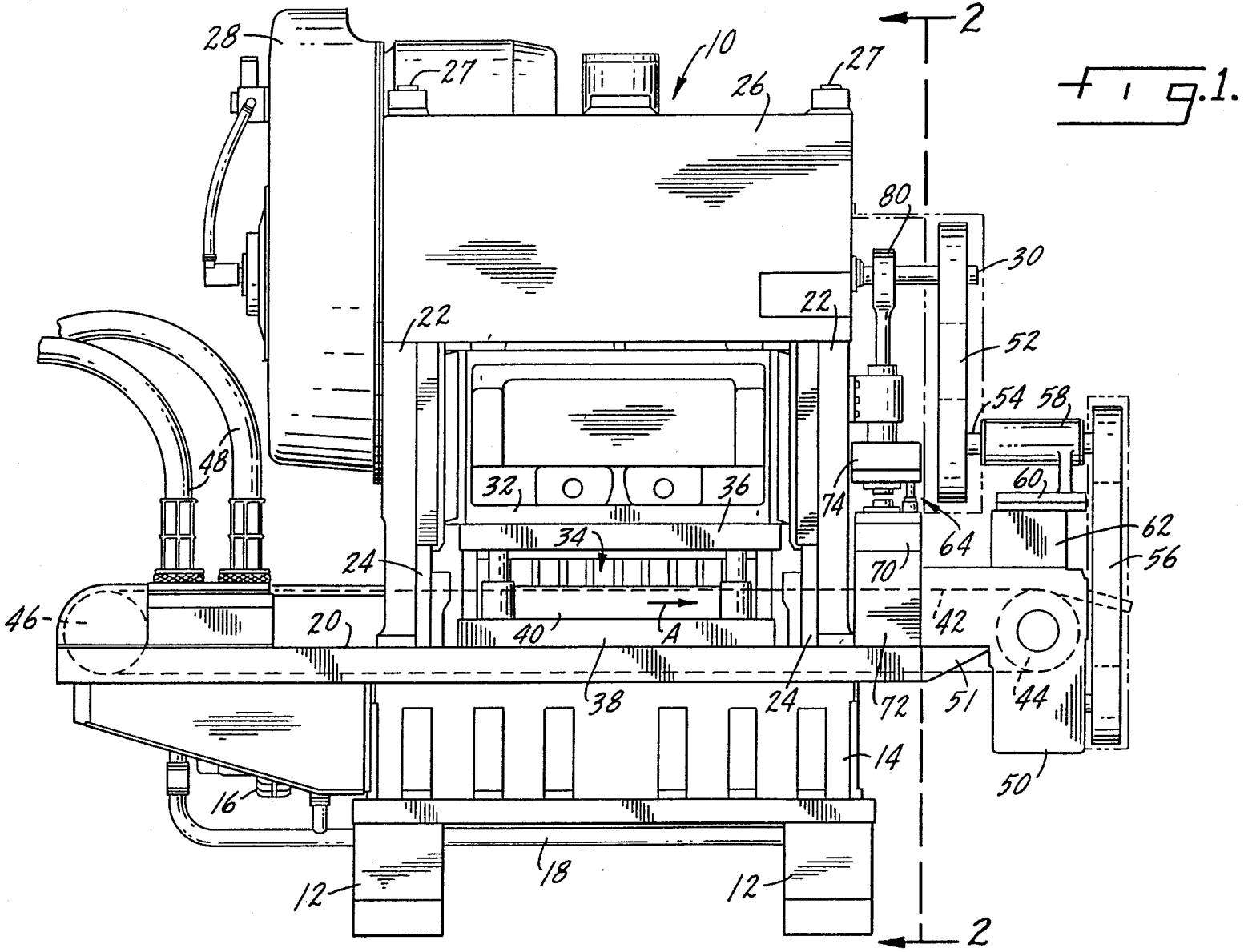
FIG. 1 is a front elevation view of the press according to the present invention.
Figure 2:
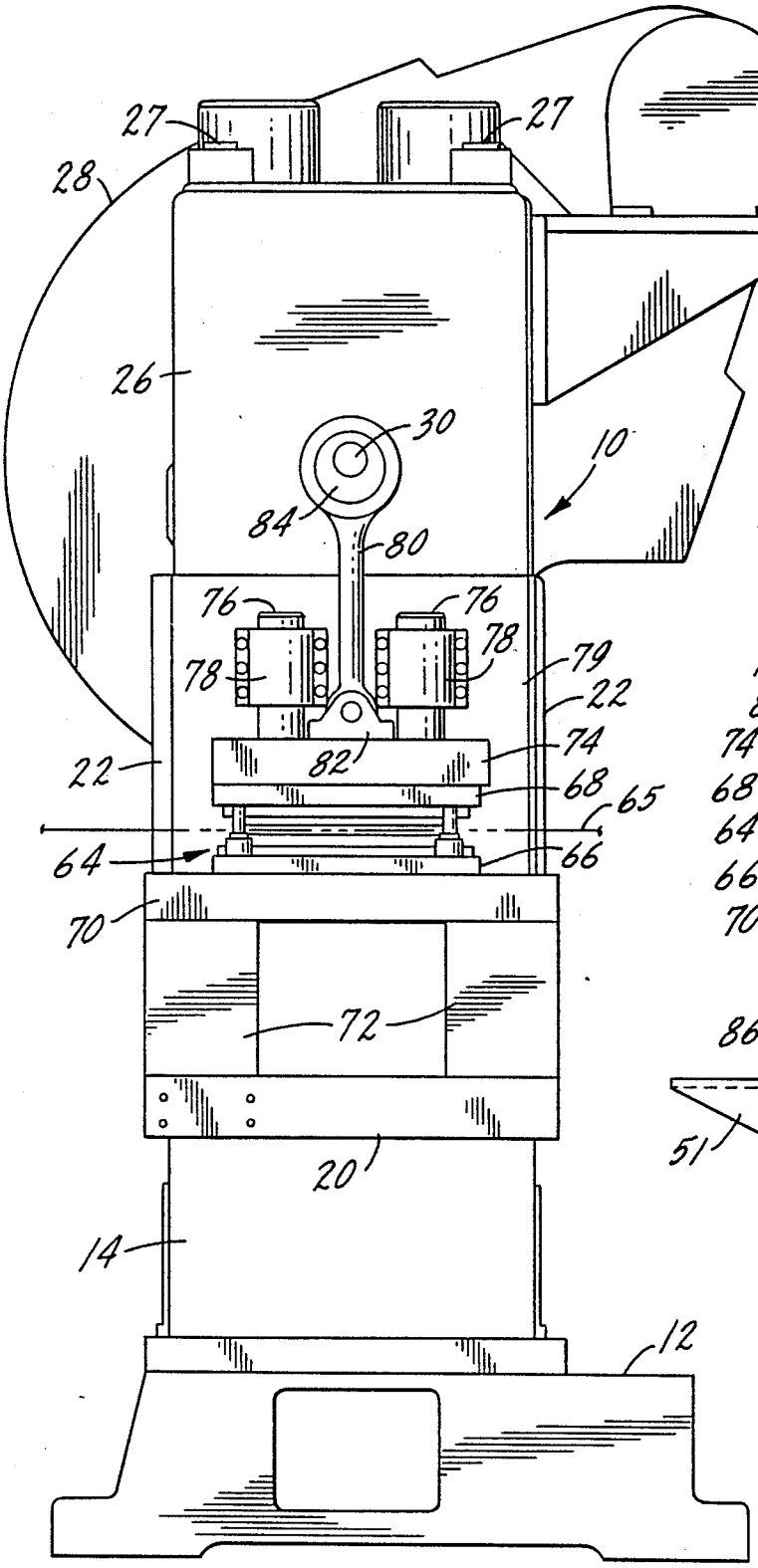
FIG. 2 is an end elevation view of the press, taken substantially along line 2—2 of FIG. 1, with background within the press omitted for clarity.
Figure 3:
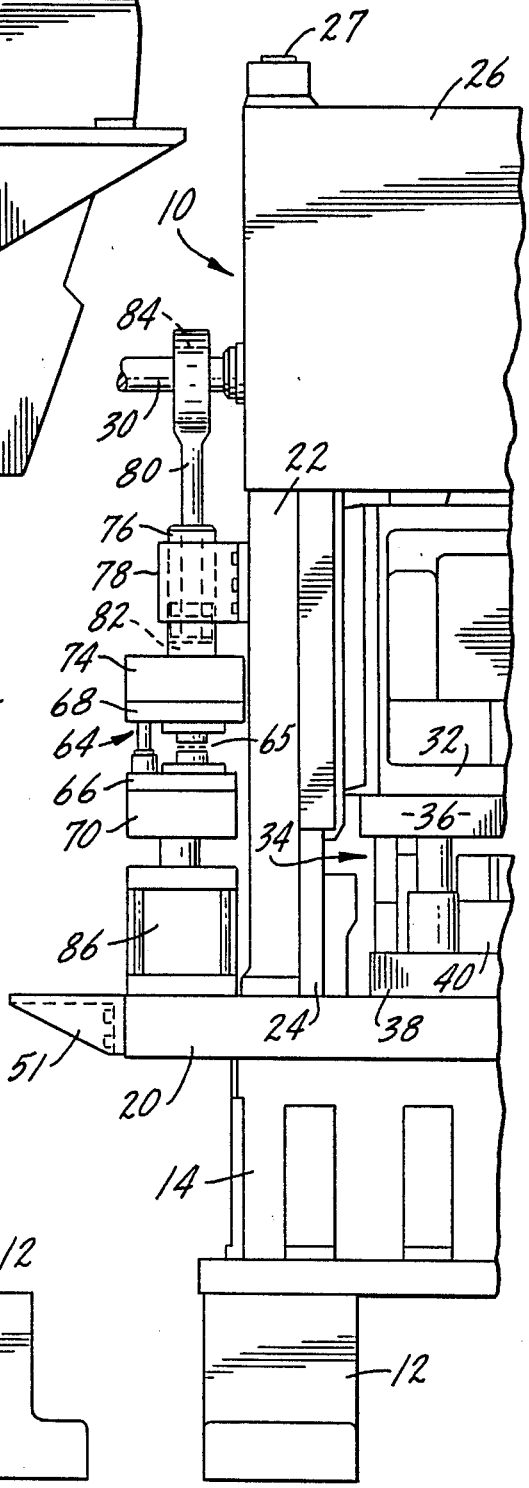
FIG. 3 is a partial rear elevation view of an alternate embodiment of the press, showing the end where the tab tooling is mounted.

The conversion system or press is shown generally at 10 in FIGS. 1—3. For purposes of description, the portion of the press shown in FIG. 1 will be termed the front of the machine. The left hand side, as seen in FIG. 1, will be called the input side with the right hand side referred to as the output side. The side of the machine shown in FIG. 3 will be denoted the back of the machine. A machine of this general character is shown and described in United States Patent application Ser. No. 143,585, filed Jan. 13, 1988, and assigned to the present assignee. The disclosure of that application is hereby incorporated by reference.

The press includes a pair of legs 12 supporting a press bed 14. Certain auxiliary equipment, such as a vacuum pump 16 and a vacuum manifold 18, may be attached to the press bed. A unitary bolster 20 rests on top of the bed 14. It will be noted that the bolster 20 extends beyond the edges of the bed 14. Details of the bolster are described in the patent application referred to above.

Four columns or uprights 22 are mounted on top of the bolster 20. Each column includes a way or track 24. A crown 26 is supported on top of the columns 22. The bed 14, bolster 20, columns 22 and crown 26 are fastened together by tie rods 27 extending through these components. The crown includes a main drive means, including a motor, crankshaft and flywheel. The flywheel is enclosed by a cover 28. The crankshaft is substantially enclosed within the crown. An extension portion 30 of the crankshaft extends out the right side of the crown. The various components of the press are driven by means of mechanical connections to the crankshaft.

A main or first ram 32 is slidably mounted between the columns 22 on the ways 24. It is driven by the crankshaft in a reciprocating motion. A first tooling set, shown generally at 34, is located between the ram 32 and the bolster 20. The first tooling is the lane die set for converting can ends. The lane tooling comprises the dies and punches required to form the ends. As is customary, the lane tooling 34 is divided into upper and lower portions, including an upper die shoe 36 and a lower die shoe 38. The upper shoe 36 is affixed to the ram 32 and moves therewith. The lower die shoe is keyed to the bolster 20. The usual die fixtures and punch holders are mounted on the die shoes. A traveling vacuum box is indicated schematically at 40. The particulars of the vacuum box are described in the patent application referred to above.

The press has a transfer or conveyor system, including an endless conveyor belt 42 revolving around head end and tail end pulleys 44 and 46, respectively. The conveyor belt travels in the direction shown by arrow A. The conveyor belt 42 has openings for receiving shells placed therein by rotary downstackers 48.

The head end pulley 44 is incorporated in a main gear box 50 which is mounted on a support member 51. The support member 51 is attached to the right hand end of the bolster 20. The gear box 50 is driven by the crankshaft extension 30 through a first drive belt 52, a transfer shaft 54 and a second drive belt 56. The shaft 54 is mounted in a bearing block 58. The bearing block 58 is mounted on the gear box 50 by means of a plate 60 and support member 62.

The second set of tooling, which in this case is the tab tooling, is shown generally at 64. A stock feed mechanism (not shown) similar to that in the patent application referred to above supplies strip stock to the tab tooling. The strip stock is illustrated diagrammatically at 65. After passing through the tab tooling the strip carries substantially completed tabs. The strip is then looped back into the lane die for attachment of the tabs to the can ends. It will be noted that the second set of tooling 64 is mounted longitudinally of the conveyor from the first or lane tooling 34. In this particular instance, it is mounted downstream of the lane tooling. This positioning of the second tooling set leaves the lateral edges of the first tooling set completely open and available for service access.

Details of the mounting arrangements for the second tooling set are shown in FIG. 2. The second tooling set 64 has upper and lower tooling including a lower die shoe 66 and a punch holder plate 68. The die shoe and punch holder carry the usual dies and punches necessary for forming tabs. The die shoe 66 is mounted on a secondary bolster 70. Bolster 70 is in turn supported by spacer blocks 72 on the right hand extension portion of bolster 20. The punch holder 68 is fastened to a second ram 74. The second ram 74 includes a pair of upstanding posts 76. The posts are slidably received in a pair of sleeves 78. The sleeves are mounted on a plate 79 which is fastened to the columns 22.

The second ram 74 is actuated by a connecting arm 80 attached to the second ram by means of a bracket 82. The connecting arm 80 is attached to the crankshaft extension 30 by means of an eccentric mounting member 84. As the crankshaft extension 30 rotates, it drives the eccentric mounting member 84 in a manner such that the connecting arm 80 reciprocates up and down. The combination of the posts 76 and sleeves 78 constrain the second ram 74 to a uniform up and down motion. The mounting member 84 may be arranged so as to drive the second ram 74 out of phase with the first ram 32.

An alternate embodiment of the press is shown in FIG. 3. In this embodiment, the spacers supporting the second ram 70 are replaced by hydraulic lift cylinders 86. The cylinders provide a drop-away and quick-lift capability for moving the second bolster 70 to a lowered maintenance position and back to a raised operating position. The drop-away bolster is desirable from a maintenance standpoint. Consider that the stroke of the second ram 74 may be on the order of only one inch or so. Thus, even when the ram 74 is at top dead center, there is insufficient clearance between the upper and lower tooling to perform in situ maintenance on the tooling. The use of hydraulic cylinders 86 permits the second bolster 70 to be dropped downwardly, providing sufficient clearance for maintenance access to the second die set. This allows maintenance of the die set without removing it from the press. It will be understood that other quick lift mechanisms could be used in place of the cylinders 86. For example, jack screws could serve the same purpose.

Whereas a preferred form of the invention has been shown and described, it will be realized that modifications could be made thereto without departing from the scope of the following claims.

I claim:

1. A press for converting work pieces into parts, comprising a bed;

a bolster mounted on the bed;

a conveyor mounted on the bolster for carrying work pieces through the press;

a plurality of columns mounted on the bolster and having a way attached to at least one side of each column;

main drive means mounted on the columns;

a first ram slidable upon the ways between the columns and driven by the main drive means to reciprocate toward and away from the bolster;

first upper and lower tooling means attached to the first ram and bolster, respectively, and having a plurality of stations for converting said work pieces into parts;

guide sleeves attached to a side opposite the one side of at least two of the columns longitudinally spaced from the first tooling means;

a second ram including posts slidable in the guide sleeves, the second ram being driven by the main drive means to reciprocate toward and away from the bolster;

second upper and lower tooling means attached to the second ram and bolster, respectively, the bolster extending beyond the columns to support the second tooling means; and a pair of spacers resting on the bolster and supporting a second bolster on which the lower tooling of the second tooling means is mounted.

2. The press of claim 1 wherein the first and second rams are driven out of phase with one another.

3. The press of claim 1 wherein the first tooling means is conversion tooling for forming easy-open can ends and the second tooling means is tab tooling for forming tabs for easy-open can ends.

4. The press of claim 1 wherein the main drive means comprises a crankshaft and the second ram is driven by a connecting arm eccentrically mounted on the crankshaft and extending to the second ram.

5. A press for converting easy-open can ends, comprising:

a press bed;

a plurality of columns supported on the bed and supporting a main drive means;

a first ram slidably mounted between the columns and driven in a reciprocating manner by the drive means;

conversion tooling for forming easy-open can ends including lower tooling supported on the bed and upper tooling mounted on the first ram and moveable therewith into and out of operative engagement with the lower tooling, the conversion tooling having a plurality of work stations arranged one after another and defining a longitudinal center line;

a second ram slidably mounted outside the columns at a location where it intersects the longitudinal center line of the conversion tooling, the second ram being driven in a reciprocating manner by the drive means;

tab tooling for forming easy-open can tabs including lower tooling supported on the bed and upper tooling mounted on the second ram and moveable therewith into and out of operative engagement with the lower tooling;

a bolster disposed between the bed and columns and extending beyond the columns to support both the lower tooling of both the conversion and tab tooling; and a pair of spacers resting on the bolster and supporting a second bolster on which the lower tooling of the tab tooling is mounted.

6. The press of claim 5 wherein the first and second rams are driven out of phase with one another.

7. The press of claim 5 wherein the main drive means comprises a crankshaft and the second ram is driven by a connecting arm eccentrically mounted on the crankshaft and extending to the second ram.

8. A press for converting work pieces into parts, comprising a bed;

a bolster mounted on the bed;

a conveyor mounted on the bolster for carrying work pieces through the press;

a plurality of columns mounted on the bolster and having a way attached to at least one side of each column;

main drive means mounted on the columns;

a first ram slidable upon the ways between the columns and driven by the main drive means to reciprocate toward and away from the bolster;

first upper and lower tooling means attached to the first ram and bolster, respectively, and having a plurality of stations for converting said work pieces into parts;

guide sleeves attached to a side opposite the one side of at least two of the columns longitudinally spaced from the first tooling means;

a second ram including posts slidable in the guide sleeves, the second ram being driven by the main drive means to reciprocate toward and away from the bolster; and second upper and lower tooling means attached to the second ram and bolster, respectively, the bolster extending beyond the columns to support the second tooling means; and second moveable tooling support means mounted on the bolster moveable between an operating position and a maintenance position, and a second bolster mounted on the moveable tooling support means with the second lower tooling being supported on the second bolster.

9. A press for converting easy-open can ends, comprising:

a press bed;

a plurality of columns supported on the bed and supporting a main drive means;

a first ram slidably mounted between the columns and driven in a reciprocating manner by the drive means;

conversion tooling for forming easy-open can ends including lower tooling supported on the bed and upper tooling mounted on the first ram and moveable therewith into and out of operative engagement with the lower tooling, the conversion tooling having a plurality of work stations arranged one after another and defining a longitudinal center line;

a second ram slidably mounted outside the columns at a location where it intersects the longitudinal center line of the conversion tooling, the second ram being driven in a reciprocating manner by the drive means;

tab tooling for forming easy-open can tabs including lower tooling supported on the bed and upper tooling mounted on the second ram and moveable therewith into and out of operative engagement with the lower tooling; and moveable tab tooling support means mounted on the bed moveable between an operating position and a maintenance position, and a bolster mounted on the support means with the moveable tab tooling lower tab tooling being supported on the bolster.

10. A press for converting easy-open can ends, comprising:

a press bed;

a plurality of columns supported on the bed and supporting a main drive means which includes a crankshaft having an extension portion which extends beyond the columns;

a first ram slidably mounted between the columns and driven in a reciprocating manner by the drive means;

conversion tooling for forming easy-open can ends including lower tooling supported on the bed and upper tooling mounted on the first ram and moveable therewith into and out of operative engagement with the lower tooling, a second ram slidably mounted outside the columns and driven in a reciprocating manner by a connecting arm eccentrically mounted on the extension portion of the crank shaft;

tab tooling for forming easy-open can tabs including lower tooling supported on the bed and upper tooling mounted on the second ram and moveable therewith into and out of operative engagement with the lower tooling;

a bolster disposed between the bed and columns and extending beyond the columns to support both the lower tooling of both the conversion and tab tooling; and a pair of spacers resting on the bolster and supporting a second bolster on which the lower tooling of the tab tooling is mounted.

11. A press for converting easy-open can ends, comprising:

a press bed;

a plurality of columns supported on the bed and supporting a main drive means which includes a crankshaft having an extension portion which extends beyond the columns;

a first ram slidably mounted between the columns and driven in a reciprocating manner by the drive means;

conversion tooling for forming easy-open can ends including lower tooling supported on the bed and upper tooling mounted on the first ram and moveable therewith into and out of operative engagement with the lower tooling, a second ram slidably mounted outside the columns and driven in a reciprocating manner by a connecting arm eccentrically mounted on the extension portion of the crank shaft;

tab tooling for forming easy-open can tabs including lower tooling supported on the bed and upper tooling mounted on the second ram and moveable therewith into and out of operative engagement with the lower tooling;

a bolster disposed between the bed and columns and extending beyond the columns to support both the lower tooling of both the conversion and tab tooling; and tab tooling support means mounted on the bolster and moveable between an operating position and a maintenance position, and a second bolster mounted on the support means with the tab tooling lower tab tooling being supported on the second bolster.

* * * * *